US008919768B2

(12) United States Patent
Mo

(10) Patent No.: US 8,919,768 B2
(45) Date of Patent: Dec. 30, 2014

(54) FIRST SHEET JOB OFFSET

(75) Inventor: Jiangxiao Mo, Vancouver, WA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 741 days.

(21) Appl. No.: 13/123,671

(22) PCT Filed: Nov. 5, 2008

(86) PCT No.: PCT/US2008/082479

§ 371 (c)(1),
(2), (4) Date: Apr. 11, 2011

(87) PCT Pub. No.: WO2010/053477

PCT Pub. Date: May 14, 2010

(65) Prior Publication Data

US 2011/0261409 A1 Oct. 27, 2011

(51) Int. Cl.

| | |
|---|---|
| ***B65H 31/00*** | (2006.01) |
| ***G03G 15/00*** | (2006.01) |
| ***B65H 31/20*** | (2006.01) |
| ***B65H 33/06*** | (2006.01) |
| ***B65H 29/68*** | (2006.01) |
| ***B41J 13/00*** | (2006.01) |

(52) U.S. Cl.

CPC ..... *B41J 13/0036* (2013.01); *B65H 2406/12* (2013.01); *B65H 2301/4461* (2013.01); *G03G 2215/00599* (2013.01); *B65H 2405/1112* (2013.01); *G03G 15/6573* (2013.01); *B65H 2405/12* (2013.01); *B65H 31/20* (2013.01); *B65H 2513/108* (2013.01); *B65H 2406/14* (2013.01); *B65H 2220/02* (2013.01); *B65H 2220/11* (2013.01); *B65H 33/06* (2013.01); *B65H 2405/1118* (2013.01); *B65H 2301/42194* (2013.01); *B65H 2301/4263* (2013.01); *B65H 2511/415* (2013.01); *B65H 2513/10* (2013.01); *B65H 2405/1122* (2013.01); *G03G 2215/00949* (2013.01); *G03G 15/6547* (2013.01); *B65H 29/68* (2013.01)

USPC ..... 271/207; 399/404

(58) Field of Classification Search

USPC ..... 271/298, 306, 307, 308, 309, 311, 312, 271/176, 182, 189, 195, 202, 207, 220, 271/221; 270/58.1, 58.11, 58.12, 58.17, 270/58.27; 399/403, 404, 405; 414/791.2

See application file for complete search history.

(56) References Cited

U.S. PATENT DOCUMENTS

| | | | | |
|---|---|---|---|---|
| 3,698,709 | A * | 10/1972 | Heal et al. | 271/183 |
| 5,897,250 | A | 4/1999 | Kirai et al. | |
| 6,227,531 | B1 | 5/2001 | Guerrero et al. | |

(Continued)

FOREIGN PATENT DOCUMENTS

| | | |
|---|---|---|
| CN | 1361502 | 7/2002 |
| CN | 1754801 | 4/2006 |

(Continued)

OTHER PUBLICATIONS

The International Search Report and the Written Opinion of the International Searching Authority for International App No. PCT/US2008/082479 dated Aug. 5, 2009, pp. 14.

*Primary Examiner* — Thomas Morrison

(74) *Attorney, Agent, or Firm* — Hewlett-Packard Patent Department; Chun Kuo

(57) ABSTRACT

An embodiment of the invention relates to a method for creating at least one first sheet job offset including polling a printing spool and determining whether at least one print job is queued in the printing spool, determining whether a first sheet of the at least one print job is ready to be outputted from a printing apparatus after the at least one print job is determined to be queued in the printing spool, configuring an outputting mechanism to accelerate the first sheet of the at least one print job out of the printing apparatus, and configuring the outputting mechanism to decelerate each remaining sheet of the at least one print job out of the printing apparatus.

13 Claims, 7 Drawing Sheets

(56) References Cited

U.S. PATENT DOCUMENTS

| | | | | |
|---|---|---|---|---|
| 6,290,220 | B1 | 9/2001 | Takehara et al. | |
| 6,669,191 | B2 * | 12/2003 | Lee | 271/189 |
| 7,213,807 | B2 | 5/2007 | Blanchard, Jr. et al. | |
| 8,315,550 | B2 * | 11/2012 | Pinney et al. | 399/404 |
| 2004/0084827 | A1 | 5/2004 | Takamura | |
| 2005/0098936 | A1 | 5/2005 | Blanchard | |
| 2008/0154426 | A1 * | 6/2008 | Kikuchi | 700/219 |

FOREIGN PATENT DOCUMENTS

| | | | |
|---|---|---|---|
| CN | 101289148 | | 10/2008 |
| EP | 0959034 | | 11/1999 |
| JP | 3026939 | | 2/1991 |
| JP | 4-191242 | * | 7/1992 |
| JP | 11-33475 | A | 12/1999 |
| JP | 11334975 | | 12/1999 |
| JP | 2004-196549 | A | 7/2004 |

* cited by examiner

FIRST SHEET JOB OFFSET

CROSS-REFERENCE TO RELATED APPLICATION

This application is a national stage application under 35 U.S.C. §371 of PCT/US2008/082479, filed Nov. 5, 2008.

BACKGROUND

Creating a print job offset conventionally involves offsetting one or more entire print jobs or utilizing sheets to act as separators between each print job. This often results in repeated and continual stress on one or more motors in having to repeatedly perform the motions of shifting and adjusting speeds and/or positions for each print job. As a result, a printing apparatus may fail more frequently or the printing apparatus life may be reduced. Furthermore, resources, such as sheets, replacement parts, and technical support, may be wasted and/or increased.

BRIEF DESCRIPTION OF THE DRAWINGS

Various features and advantages of the invention will be apparent from the detailed description which follows, taken in conjunction with the accompanying drawings, which together illustrate, by way of example, features of the invention and wherein.

DETAILED DESCRIPTION

The present invention differs from previous approaches by creating one or more print job offsets with a first sheet job offset for each print job without repeatedly and continually stressing one or more outputting mechanisms for a printing apparatus and without wasting additional resources. A common practice for conventional print job offsetting is to offset the entire print job and/or use extra sheets as bookmarks between each print job. As a result, a user may find that he/she may have to frequently perform maintenance on the machine since the motors and outputting means are being worn out at a continual and an accelerated rate. In addition, extra time, sheets, and/or other additional resources are wasted. The present invention alleviates much of the stress on the printing apparatus and burden on the user by not offsetting an entire print job and/or wasting resources, yet continues to perform print job offsetting that can separate each print job efficiently and effectively using a first sheet of each print job.

Figure 1:
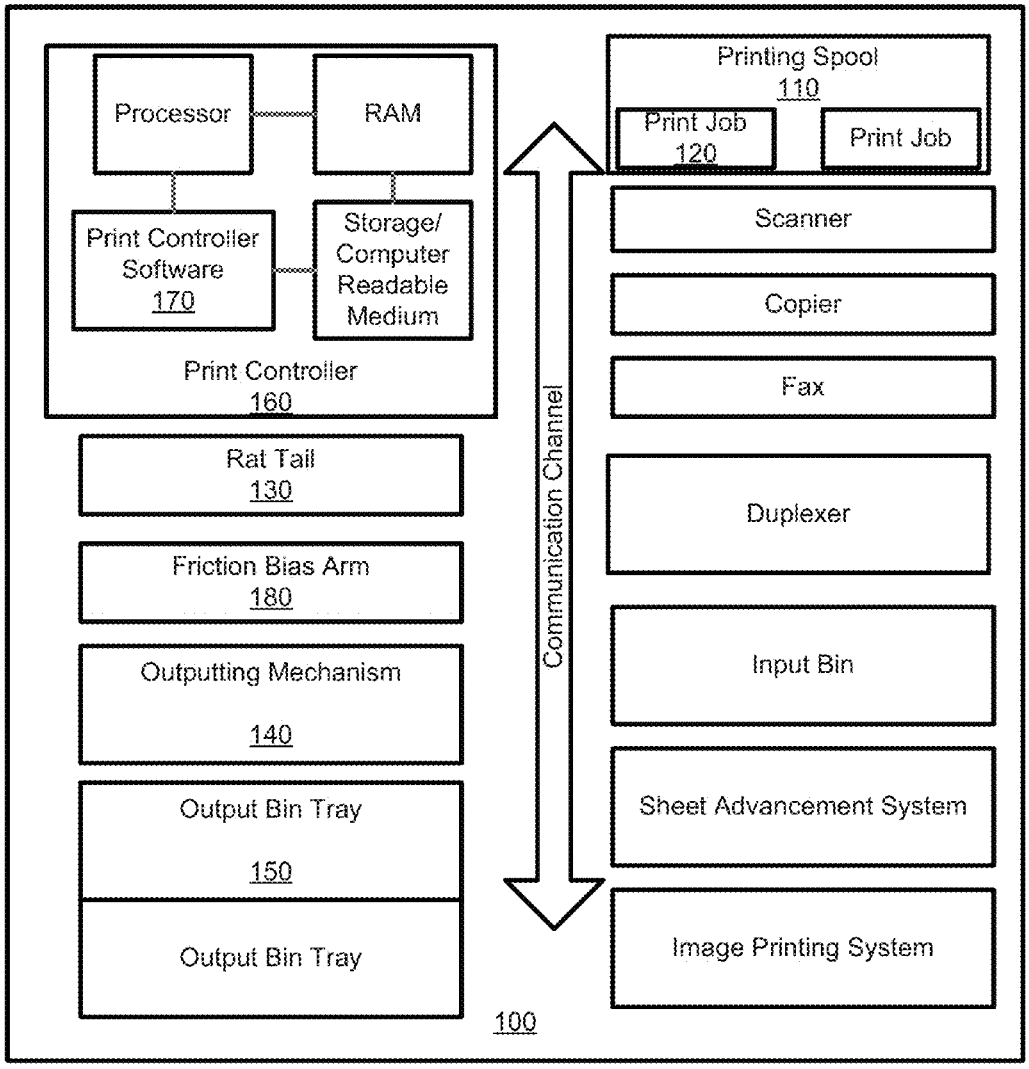
FIG. 1 illustrates a printing apparatus, various components and devices comprising the printing apparatus, and various components and devices attached to the printing apparatus according to an embodiment of the invention.

FIG. 1 illustrates a printing apparatus, various components and devices comprising the printing apparatus, and various components and devices attached to the printing apparatus according to an embodiment of the invention. A printing apparatus is an apparatus that may access print data from at least one print job to print one or more images, text, and/or patterns on one or more sides of a sheet upon instruction. As illustrated in FIG. 1, the printing apparatus may comprise a print controller, at least one rat tail, at least one friction bias arm, an outputting mechanism, one or more output bin trays, a printing spool, which may further include at least one print Job, a scanner, a copier, a fax, a duplexer, one or more input bins, one or more communication channels, a sheet advancement system, and an image printing system. Further, as illustrated in FIG. 1, the print controller which may further include a PROCESSOR, RAM, storage, and print controller software. The printing apparatus may comprise additional devices and/or components and may be attached and/or connected to additional devices or components in addition to and/or in lieu of those depicted in FIG. 1.

As noted above, the printing apparatus 100 may comprise a printer controller 160, which may be used to control the printing apparatus 100 and comprise a PROCESSOR, RAM, Storage/Computer Readable Medium, and print controller software 170. The print controller software 170 may manage the operations of the printing apparatus 100, in conjunction with the print controller 160, by sending instructions to one or more components and/or devices comprising the printing apparatus 100 and/or connected to the printing apparatus 100. The print controller software 170 may be firmware that is embedded onto the print controller 160 or the printing apparatus 100. Additionally, the print controller software 170 may be a software application stored on the printer apparatus 100 through a storage medium readable and accessible by the printing apparatus 100 or the print controller software 170 may be stored on a computer readable medium readable and accessible by the printing apparatus 100 from a different location. Further, the print controller software 170 may be stored and/or accessed through a server connected through a local area network or a wide area network. The print controller software 170 may communicate with the print controller 160 and/or other additional devices and/or components connected to the printing apparatus 100 physically or wirelessly through one or more communication channels included in or attached to the printing apparatus 100.

The print controller software 170 may poll a printing spool 110 to determine whether at least one print job 120 is queued in the printing spool 110. A printing spool 110 may include data of multiple print jobs, including at least one print job 120, that has been queued for printing. Further the print controller software 170 may access each print job and the data inside each print job when they are ready to be printed. As illustrated in FIG. 1, printing spool 110 may have at least one print job 120 queued. In addition, printing spool 110 may have additional print jobs queued. At least one print job 120 may be the next print job queued in the printing spool 110 ready for printing. When at least one print job 120 is ready to be printed, the print controller software 170 may access at least one print job 120 and the data on at least one print job 120. At least one print job 120 may include data indicating the number of pages to be printed, whether to print in duplex mode or single sided mode, the type of sheets to print on, such as media type, as well as the size of sheets to print on. Further, at least one print job 120 may indicate the number of pages to be printed on each side of each sheet. In one embodiment, at least one print job 120 may indicate that a page is to be printed on a single side of sheet. In another embodiment, at least one print job 120 may indicate that a page of at least one print job 120 is to be printed on each side of the sheet. Additionally, at least one print job 120 may indicate that multiple pages of at least on print job 120 are to be printed on a single side of a sheet or multiples pages are to be printed on each side of the sheet. At least one print job 120 in the printing spool 110 may be created from images and/or data that have been captured through a scanner, images and/or data that have been received from a fax, images and/or data that have been captured or received from a copier, and images and/or data that have been sent from another device, such as a computer.

After accessing the data from at least one print job 120, the print controller software 170 may send instructions to the print controller 160 and sheet advancement system according to the data from at least one print job 120. Additionally, the print controller software 170 may determine, based on whether at least one print job 120 specifies to be printed single sided or double sided, when a first sheet will be ready to be outputted from the printing apparatus 100.

In printing each page of each print job in the printing spool 110, the print software controller 170 may initially send instructions to the sheet advancement system to acquire sheets from one or more input bins. The print controller software 170 may then send an instruction for the sheet advancement system to transfer one or more sheets to the image printing system, where the print controller software 170 may utilize the data from each print job to determine what images, text, and/or patterns are to be printed on each page of the corresponding print job, as well as the number of pages to be printed on each side of a sheet. A sheet is the physical media that the one or more pages of each print job may be printed on. Each side of the sheet may be printed on with one or more pages from the corresponding print job. In one embodiment, if the data from at least one print job 120 has indicated that each sheet of at least one print job 120 is to be printed double sided, the print controller software 170 may next send an instruction for each sheet of at least one print job 120 to be sent to the duplexer where it will be flipped and returned to the image printing system where the next page, or set of pages, of at least one print job 120 will be printed on the other side of each sheet. The general method disclosed above may be used for the printing of each sheet of each print job in the printing spool 110. Additional methods and/or additional device or components may be utilized in the printing of each sheet of at least one print job 120 and any additional print jobs queued in the printing spool 110 in addition to and/or in lieu of those depicted above.

In outputting each sheet of each print job, the print controller software 170 will initially determine when a first sheet of the corresponding print job is ready to be outputted from the printing apparatus 100. In one embodiment, a first sheet of at least one print job 120 is ready to be outputted when all of the images, text, and/or patterns designated to be printed on a single side or both sides of the sheet have been imprinted onto one or both designated sides by the image printing system. The print software controller 170 may then send one or more instructions to one or more outputting mechanisms 140, at least one friction bias arm 180, and/or at least one rat tail 130 to accelerate the first sheet of at least one print job 120 out of the printing apparatus 100 by increasing an output force, accelerating a rotation, and/or raising at least one friction bias arm 180 and/or at least one rat tail 130. As a result, the distance traveled by the first sheet of at least one print job 120 outputted from the printing apparatus 100 will be increased and at least one first sheet job offset will be created for at least one print job 120. A first sheet job offset is a print job that has been outputted from the printing apparatus 100 where the first sheet of the corresponding print job is offset from each remaining sheet of the corresponding print job. The first sheet of the corresponding print job will be offset a distance greater than each remaining sheet in the corresponding print job. Each remaining sheet of the corresponding print job will not be offset and will be evenly stacked one on top of another at a distance less than the first sheet of the corresponding print job.

After the first sheet of the corresponding print job has been outputted from the printing apparatus 100, the print controller software 170 may then send another instruction to one or more outputting mechanisms 140, at least one friction bias arm 180, and/or at least one rat tail 130 to decrease output force, decelerate a rotation, and/or lower at least one friction bias arm 180 and/or at least one rat tail 130 to decrease the travel distance traveled for each remaining sheet of a corresponding print job, when outputted from the printing apparatus 100. The method disclosed above may be utilized for the outputting of at least one print job 120 and any additional print jobs queued in the printing spool 110. Additional methods and/or additional device or components may be utilized in the outputting of each sheet of at least one print job 120 and any additional print jobs queued in the printing spool 110 in addition to and/or in lieu of those depicted above.

Figure 2:
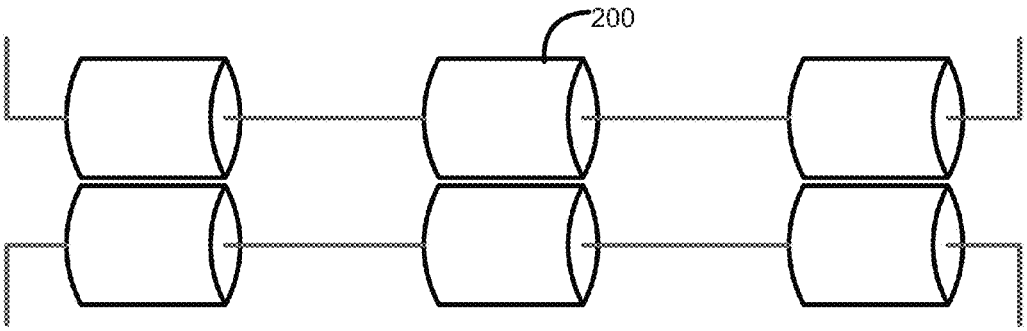
FIG. 2 illustrates one or more outputting mechanisms which may be utilized to transfer sheets out of a printing apparatus and to an output bin tray according to an embodiment of the invention.
Figure 2:
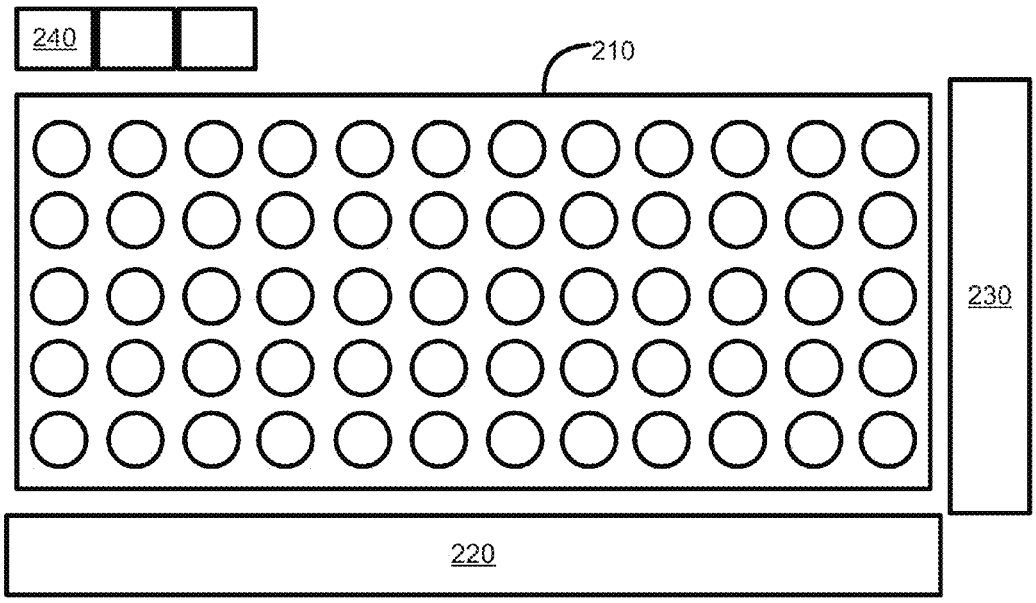

FIG. 2 illustrates one or more outputting mechanisms which may be utilized to transfer sheets out of a printing apparatus and to an output bin tray according to an embodiment of the invention. One or more outputting mechanisms may include one or more rollers 200 and/or one or more air nozzles 210. Further, one or more air nozzles may have one or more levers 220, 230 and/or one or more doors 240 that may be utilized to control an amount of air flow exiting one or more air nozzles 210. Additional devices and/or components, including additional rollers and/or air nozzles, may be utilized to transfer sheets out of a printing apparatus and into an output bin tray in addition to and/or in lieu of those depicted in FIG. 2.

As illustrated in FIG. 2, one or more rollers 200 may be utilized by a printing apparatus to transfer sheets out of the printing apparatus. Each roller 200 may be in the shape of a sphere, cylinder, or any other uniformly round shape. Further, each roller 200 may be mounted on a bar and/or rod, which may be attached to the printing apparatus and rotated. Each roller 200 may independently or in conjunction be driven to rotate at various speeds by a motor whenever a sheet of a print job is to be outputted from the printing apparatus. Further, the rate and speed of rotation for one or more rollers 200 may be adjusted by a print controller software sending instructions for the motor, connected to the roller, to accelerate or decelerate. By adjusting the speed of rotation for each roller 200 independently or conjunctively, a sheet may be accelerated or decelerated and the distance a sheet travels when outputted from the printing apparatus may be controlled.

In one embodiment, the print controller software may instruct the motor to rotate one or more rollers 200 at an accelerated speed for a first sheet of at least one print job when the first sheet of at least one print job is detected to be ready for output from the printing apparatus. The first sheet of at least one print job will thus be accelerated out of the printing apparatus. After the first sheet has been outputted from the printing apparatus, the print controller software may send a second instruction for the motor to rotate one or more rollers 200 at a normal or decelerated speed for each remaining sheet of at least one print job. Each remaining sheet of at least one print job will then be decelerated out of the printing apparatus. As a result, when the first sheet of at least one print job is outputted from the printing apparatus, the first sheet will travel a greater distance than each remaining sheet of at least one print job and thereby create a first sheet job offset. When processing a subsequent print job, the print controller may again send instructions to the motor to rotate one or more rollers 200 at an accelerated speed for a first sheet of the corresponding print job and then rotate at a normal or decelerated speed for each remaining sheet of the corresponding print job.

Further, as illustrated in FIG. 2, one or more air nozzles 210 may be utilized by a printing apparatus to accelerate one or more sheets out of the printing apparatus and/or decelerate one or more sheets out of the printing apparatus. One or more air nozzles 210 may be mounted onto the printing apparatus in an array or matrix layout and fixed or attached in a stationary position. In addition one or more air nozzles 210 may each have an independent source of air flow or share a common source of air flow. A motorized fan or any other additional device or component which may generate and/or output air flow at different strengths, upon instruction by the print controller software, at a constant or variable rate may be utilized by the printing apparatus to create air flow for one or more air nozzles 210. By adjusting the amount of air flow and the number of air nozzles 210 to be open at a given time, one or more sheets may be accelerated or decelerated out of the printing apparatus and the distance a sheet travels when outputted from the printing apparatus may be controlled.

Even when sharing a common source of air flow, the output of each air nozzle 210 or an array or matrix of air nozzles 210 may be controlled by one or more doors 240 opening and/or closing or one or more levers 220, 230 extending or retracting over each air nozzle 210 independently or over an array or matrix of air nozzles 210 upon instruction by the print controller software. As noted above and illustrated in FIG. 2, one or more air nozzles may have one or more levers 220, 230 which may be extended or retracted and thus be utilized to control an amount of air flow exiting one or more air nozzles 210. One or more levers 220, 230 may be mounted onto the printing apparatus or one or more air nozzles 210 in various positions. Further, one or more levers 220, 230 may be movable manually or automatically by a user or the printing apparatus and may be extended to increase a surface area of one or more levers 220, 230.

In one embodiment, lever 220 may be moved vertically, up or down, over one or more air nozzles 210 to block or unblock one or more air nozzles to control the amount of air flow exiting one or more air nozzles 210. Further, lever 230 may be moved horizontally, left or right, over one or more air nozzles 210 to block or unblock one or more air nozzles to control the amount of air flow exiting one or more air nozzles 210. In another embodiment, lever 220 may be automatically extendable in a vertical movement, up or down, from the bottom and/or top of a matrix of air nozzles 210 to block or unblock one or more air nozzles. Further lever, 230 may automatically be extendable in a horizontal movement, left or right, from the left and/or right of a matrix of air nozzles 210 to block or unblock one or more air nozzles 210.

Further, as noted above and illustrated in FIG. 2, one or more air nozzles may have one or more doors 240 that may be utilized to control an amount of air flow exiting one or more air nozzles 210. One or more doors 240 may be mounted onto the printing apparatus or on one or more air nozzles 210. Further, one or more doors 240 may be movable manually or automatically by a user or the printing apparatus. One or more doors 240 may be opened or closed individually or in unison.

In one embodiment, the print controller software may detect that a first sheet of at least one print job is ready to be outputted from the printing apparatus. The print controller software may then send an instruction to one or more doors 240 to open and/or one or more levers 220, 230 to retract to insure that each air nozzle 210 is open to increase air flow and accelerate the first sheet of at least one print job out of the printing apparatus. Additionally and/or alternatively, the print controller software may send an instruction for the motorized fan to rotate at an accelerated rate in order to increase air flow for one or more air nozzles 210 to accelerate the first sheet of at least one print job out of the printing apparatus. After the first sheet of at least one print job has been outputted from the printing apparatus, the print controller software may next send an instruction to close one or more doors 240 and/or extend one or more levers 220, 230 for one or more air nozzles 210 to decrease air flow for each remaining sheet of at least one print job so that each remaining sheet will be decelerated out of the printing apparatus. As a result, the amount of open air nozzles 210, as well as the amount of air flow provided to output each remaining sheet in at least one print job is decreased.

Additionally and/or alternatively, the print controller software may instruct the motorized fan to rotate at a normal or decelerated speed to decrease the air flow to one or more air nozzles 210. As a result, the remaining sheets of at least one print job will be decelerated out of the printing apparatus and will travel a distance shorter than the first sheet of at least one print job when outputted from the printing apparatus. Additional methods and/or a combination of the above actions may be utilized to increase and/or decrease the amount of air flow flowing out of one or more air nozzles 210 in addition to and/or in lieu of those depicted in FIG. 2 and disclosed above.

Figure 3:
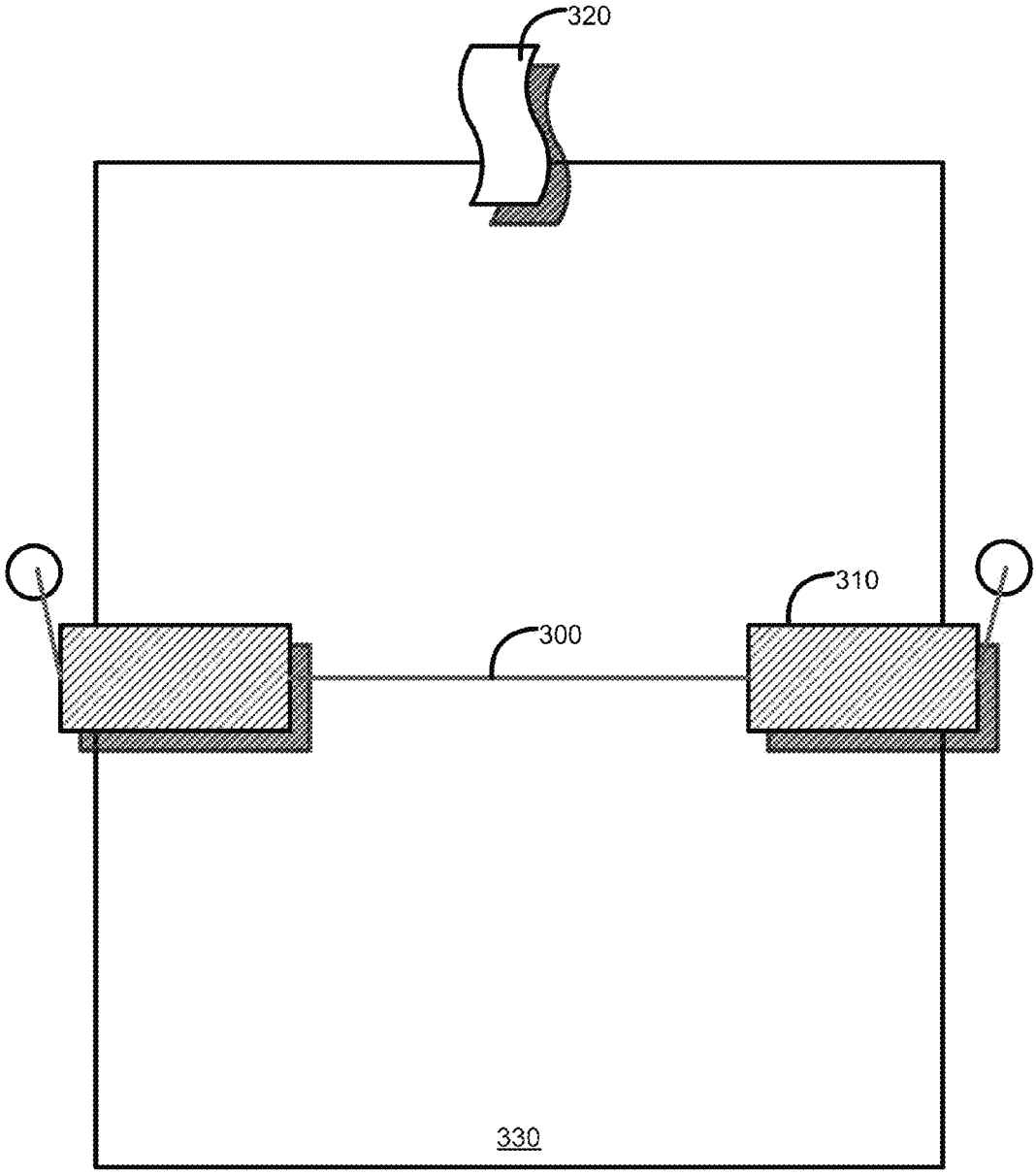
FIG. 3 illustrates at least one friction bias arm and at least one rat tail which may be attached to a printing apparatus and may be used to make contact and create friction with one or more sheets of a print job as each sheet is exiting the printing apparatus according to an embodiment of the invention.

FIG. 3 illustrates at least one friction bias arm and at least one rat tail which may be attached to a printing apparatus and may be used to make contact and create friction with one or more sheets of a print job as each sheet is exiting the printing apparatus according to an embodiment of the invention. Additional devices or components, including additional friction bias arms and/or additional rat tails, may be integrated or attached to a printing apparatus to create friction on one or more sheets of a print job in addition to and/or in lieu of those depicted in FIG. 3.

As illustrated in FIG. 3, at least one rat tail 320 may be utilized to create friction on one or more sheets of a print job to decrease the distance a sheet travels when outputted from a printing apparatus and into an output bin tray by making contact with one or more sheets of the print job. At least one rat tail 320 may be constructed of plastic, metal, other additional elements, and/or a combination of elements. Additionally, at least one rat tail 320 may be flat or it may be curved. As illustrated in FIG. 3, the bottom portion of at least one rat tail 320 may include patterns or ridges to create friction between each sheer and the rat tail 320 when the sheet travels out of the printer apparatus and makes contact with at least one rat tail 320. In one embodiment, at least one rat tail 320 may be integrated as part of the printing apparatus. In another embodiment, at least one rat tail 320 may be an accessory that may be attachable and removable from the printing apparatus.

At least one rat tail 320 may be fixed in stationary position or at least one rat tail 320 may be moved manually by a user or automatically with a spring or motor by the printing apparatus. In one embodiment, where at least one rat tail 320 is stationary, an outputting mechanism may be accelerated in order to accelerate a first sheet of each print job out of the printing apparatus. The outputting mechanism may then decelerate each remaining sheet of the print job at a force less than the force used for the first sheet. As a result, at least one rat tail 320 will make contact and create friction for each page of the print job. Because the first sheet of the corresponding print job was accelerated out of the printing apparatus, the first sheet of the corresponding print job will travel a greater distance than the remaining sheets of the corresponding print job, thereby creating at least one first sheet job offset for the corresponding print job.

In another embodiment, where the rat tail 320 is automatically movable through a spring or a motor, the print controller software may send an instruction for the spring to expand or the motor to rotate so that the rat tail 320 is raised to an elevated position. As a result, the first sheet of the corresponding print job will indirectly be accelerated out of the printing apparatus by the rat tail will not make contact with the first sheet of the corresponding print job and create friction with the first sheet of the corresponding print job. Additionally, the outputting mechanism may be accelerated in order to increase the force and travel distance of the first sheet of the corresponding print job. After the first sheet of the print job has been outputted, the print controller software may send an instruction for the spring to contract or the motor to rotate so that the rat tail 320 is lowered to a declined position. As a result, the rat tail 320 will make contact with each remaining sheet of the corresponding print job and decelerate each remaining sheet of the corresponding print job by creating friction for each remaining sheet of the corresponding print job. The first sheet of the corresponding print job will thus be offset because the first sheet of the corresponding print job will have been indirectly accelerated out of the printing apparatus by traveling a greater distance than each remaining sheet in the corresponding print job due to at least one rat tail 320 not making contact and creating friction with the first sheet, as it does for each remaining sheet of the corresponding print job. At least one rat tail 320 may be fixed or moved into additional positions manually or automatically using additional means in addition to and/or in lieu of those depicted in FIG. 3 and disclosed above.

Further, FIG. 3 illustrates at least one friction bias arm 300 that may be integrated or attached to a printing apparatus to make contact and create friction when making contact with one or more sheets outputted from the printing apparatus. At least one friction bias arm 300 includes a bar or rod that has one or more pads 310 mounted onto the bar or rod. As illustrated in FIG. 3, the pads 310 may include patterns, ridges, and/or a rough surface to create friction between each sheet and each pad 310 when each sheet travels out of the printer apparatus and makes contact with each pad 310. Alternatively and/or additionally, the pads may be made of rubber or other materials known to create friction. At least one friction bias arm 300 is attached to a printing apparatus and may be fixed in a position or moved up and/or down by the printing apparatus, upon instruction by a print controller software, to create friction on one or more sheets outputted from the printing apparatus.

In one embodiment, where at least one friction bias arm 300 is stationary, an outputting mechanism may be accelerated in order to increase the force used to output a first sheet of each corresponding print job. The outputting mechanism may then output each remaining sheet of the corresponding print job at a force less than the force used for the first sheet of the corresponding print job. As a result, the friction bias arm 300 will create friction for each sheet of the corresponding print job. However, the first sheet of the corresponding print job will still travel a greater distance than the remaining sheets of the corresponding print job since the outputting mechanism was accelerated for the first sheet. As a result, at least one first sheet job offset of the corresponding print job is created.

In another embodiment, where at least one friction bias arm 300 is movable, the print controller software may send an instruction for the friction bias arm 300 to raise to an elevated position so that the friction bias arm 300 will not make contact with the first sheet of the corresponding print job and no friction will be created with the first sheet of the corresponding print job by at least one friction bias arm 300. Additionally, the outputting mechanism may be accelerated in order to increase the force and travel distance of the first sheet of the corresponding print job. After the first sheet of the corresponding print job has been outputted, the print controller software may send an instruction for at least one friction bias arm 300 to lower to a declined position so that the friction bias arm 300 will make contact with each remaining sheet of the corresponding print job and create friction with each remaining sheet of the corresponding print job. As a result, the first sheet of the corresponding print job will be offset and travel a greater distance than each remaining sheet in the corresponding print job since the friction bias arm 300 will not create friction for the first sheet of the corresponding print job, as it does each remaining sheet of the corresponding print job. At least one friction bias arms 300 may be fixed or moved into additional positions manually or automatically using additional means in addition to and/or in lieu of those depicted in FIG. 3 and disclosed above.

Figure 4:
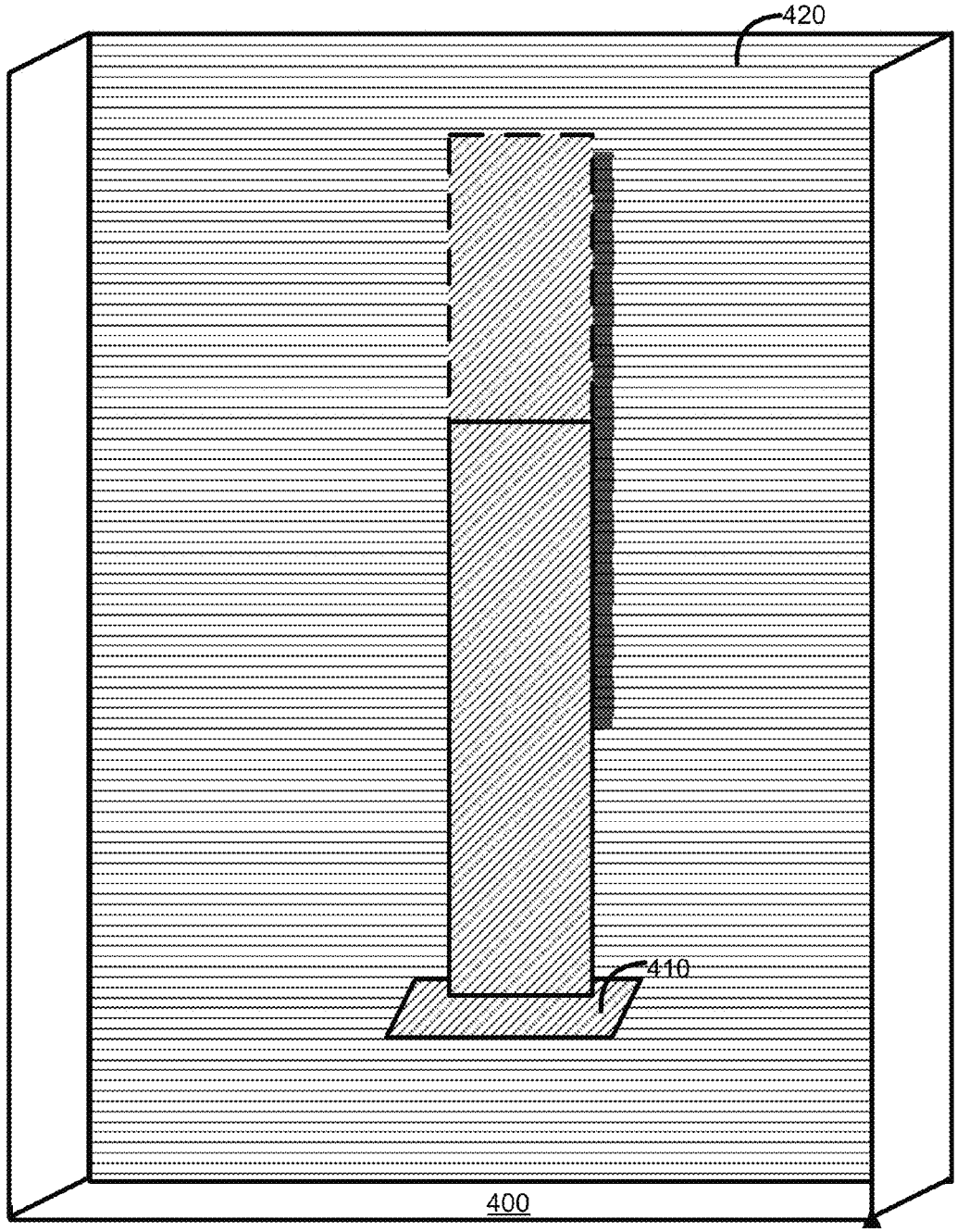
FIG. 4 illustrates an output bin tray, ridges on the output bin tray, and a stopper, attached to the output bin tray, where each print job may be stacked with a first sheet job offset according to an embodiment of the invention.

FIG. 4 illustrates an output bin tray, ridges on the output bin tray, and a stopper, attached to the output bin tray, where each print job may be stacked with at least one first sheet job offset according to an embodiment of the invention. As illustrated in FIG. 4, one or more output bin trays 400 may include ridges 420, which may be attachable and/or removable from the output bin tray 400, and a stopper 410, which may be attached to the output bin tray 400. The output bin tray 400 may include additional components and may be attached to additional devices in addition to and/or in lieu of those depicted in FIG. 4.

As noted above, one or more output bin trays 400 as illustrated in FIG. 4 is a tray that may be attached to a printing apparatus and may be used to hold and store at least one first sheet job offset, which may be separated and distinguished by one or more additional first sheet job offsets for each print job. One or more output bin trays 400 may be constructed of plastic, metal, other additional elements, and/or a combination of elements. Additionally, one or more output bin trays 400 may be positioned in a flat, horizontal position, or one or more output bin trays 400 may be positioned in a slanted, inclined position. One or more output bin trays 400 may be positioned in additional positions in addition to and/or in lieu of those depicted above in FIG. 4 and noted above.

The dimensions of one or more output bin trays 400, both horizontal dimensions and vertical dimensions, may be adjusted with an extendable and/or retractable device to support various sheet and media types and/or media types of different dimensions. Additionally, an extender device may be attached and/or removed from one or more output bin trays 400 to support various sheet and media types and/or sheets and media types of different dimensions. Further, one or more output bin trays 400 may include or be attached to a motor that may move in various directions to hold and store multiple print jobs and various print jobs of different sizes.

Additionally, as illustrated in FIG. 4, the surface of one or more output bin trays 400 may include ridges 420 to increase friction and reduce the traveling or moving of one or more sheets of a print job. The ridges 420 on one or more output bin trays 400 may be attached to each output bin tray 400 as a layer that may be added and/or removed. Additionally, the ridges may be integrated or engraved into one or more output bin trays 400. In one embodiment, one or more output bin trays 400 may not include any ridges 420 and/or patterns and, as a result, have a surface that may be flat and smooth.

Further, as illustrated in FIG. 4, the output bin tray 400 may include one or more stoppers 410. A stopper 410 is a device that may be utilized to decrease the travel distance of one or more sheets of a print job when outputting from a printing apparatus. In one embodiment, the first sheet of a print job may be outputted from the printing apparatus and one or more stoppers 410 may be utilized to insure that the first sheet does not shoot off and/or over the output bin tray 400 when an the first sheet or any remaining sheet of the print job is accelerated out of the printing apparatus with an outputting mechanism. Similar to the output bin tray 400, one or more stoppers 410 may be constructed of plastic, metal, other additional elements, and/or a combination of elements. Additionally, the position of one or more stoppers 410 may be adjustable to support various sheet and media types and/or various sheet and media dimensions. The position of one or more stoppers 410 may be adjusted manually by a user manually moving the stopper 410 or it may be adjusted automatically by a motor that one or more stoppers 410 may be attached to.

Figure 5:
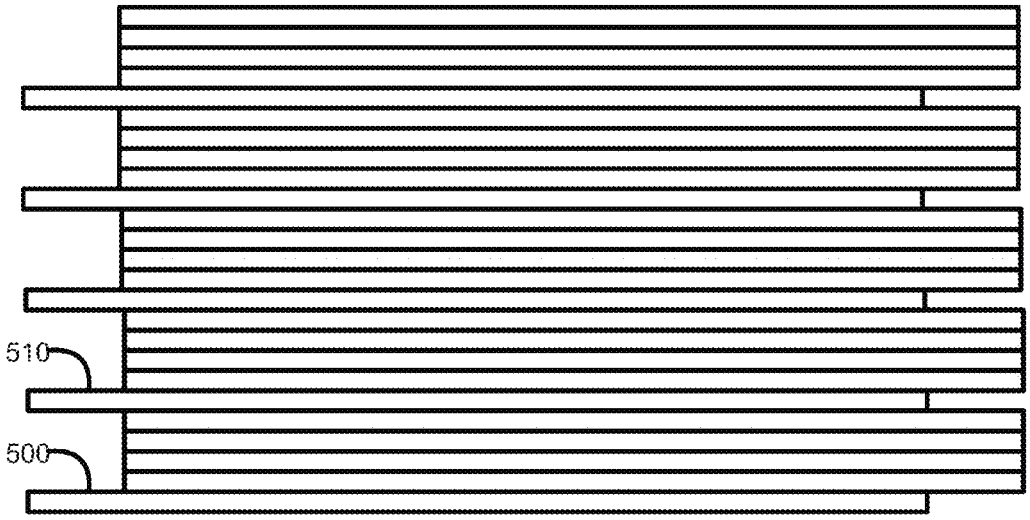
FIG. 5 illustrates multiple stacked print jobs that have been outputted from a printing apparatus with a first sheet job offset according to an embodiment of the invention.

FIG. 5 illustrates multiple stacked print jobs that have been outputted from a printing apparatus with a first sheet job offset according to an embodiment of the invention. Each print job may indicate a single media type or various media types to be used as sheets printed on by the printing apparatus. A media type may be the type of paper specified and/or used in a print job, such as A4, Letter, Envelope, Photo, etc. Further, a media type may have specific dimensions specified, such as 8×11, 5×7, 4×6, etc. A sheet may include additional media types and include additional dimensions or categories in addition to and/or in lieu of those depicted above.

As illustrated in FIG. 5, one or more print jobs 500, 510 may be separated by at least one first sheet job offset for each corresponding print job and may be stacked one on top of the other on an output bin tray. As shown in FIG. 5, print job 500 may initially be printed. The first sheet of print job 500 may have been accelerated out of the printing apparatus at a distance greater than each remaining sheet in print job 500. After each remaining sheet of print job 500 have been outputted at a distance less than the first sheet of print job 500, print job 510 may then be processed and the first sheet of print job 510 may be accelerated out of the printing apparatus at a distance greater than each remaining sheet in print job 510. If any additional print jobs are queued in the printing spool, each subsequent print job will be printed in the same manner or in a manner similar to the manner disclosed above. As a result, FIG. 5 illustrates that each print job is easily identifiable, easily distinguished, and efficiently separated from one another since a user may identify where one print job begins with the first sheet job offset for the corresponding job and where one print job ends, with the first sheet job offset for the next print job.

Figure 6:
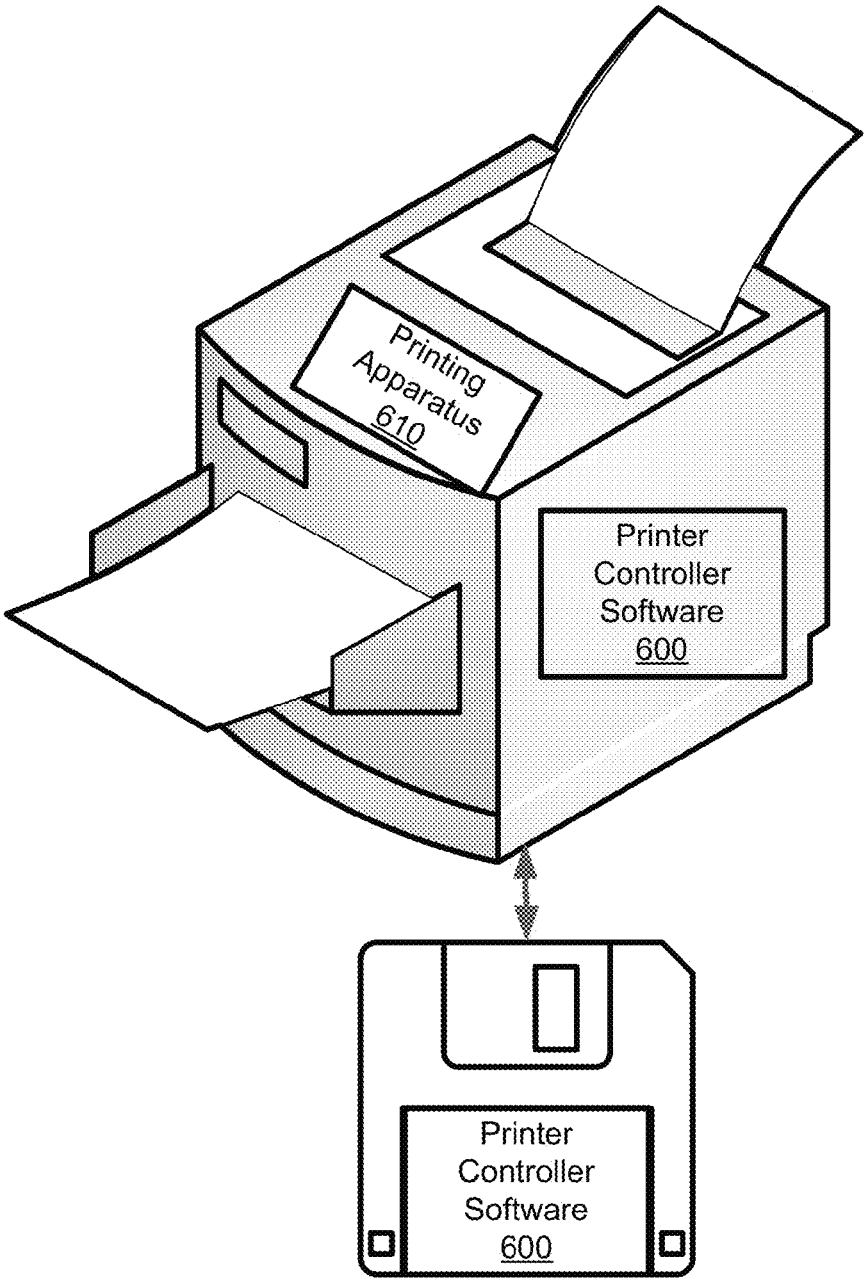
FIG. 6 illustrates a printer controller software that may be embedded into the printing apparatus and/or may be stored on a removable medium being accessed by a printing apparatus according to an embodiment of the invention.

FIG. 6 illustrates a printer controller software that may be embedded into the printing apparatus and/or may be stored on a removable medium being accessed by a printing apparatus according to one or more embodiments of the invention. As noted above, the printer controller software 600 may control and/or manager the hardware components of the printing apparatus by sending instructions and/or commands to each component of the printing apparatus independently or in conjunction using one or more communication channels.

Further, as noted above, the printer controller software 600 may be firmware that may be imbedded into one or more components of the printing apparatus 610. Additionally, the printer controller software 600 may be a software application which may be stored and accessed from a hard drive, a compact disc, a flash disk, a network drive or any other form of computer readable medium that is connected to the printing apparatus. In one embodiment, the printer controller software 600 may be stored on a server or another device that may or may not be connected to the printing apparatus 610. The printing apparatus 610 may utilize a local area network or a wide area network to store and access the printer controller software 600. The printer controller 600 may be stored and accessed from additional devices in addition to and/or in lieu of those depicted in FIG. 6.

Reference will now be made to exemplary embodiments illustrated in the drawings, and specific language will be used herein to describe the same. It will nevertheless be understood that no limitation of the scope of the invention is thereby intended. Alterations and further modifications of the inventive features illustrated herein, and additional applications of the principles of the invention as illustrated herein, which would occur to one of ordinary skill within the relevant art and having possession of this disclosure, are to be considered within the scope of the invention.

Figure 7:
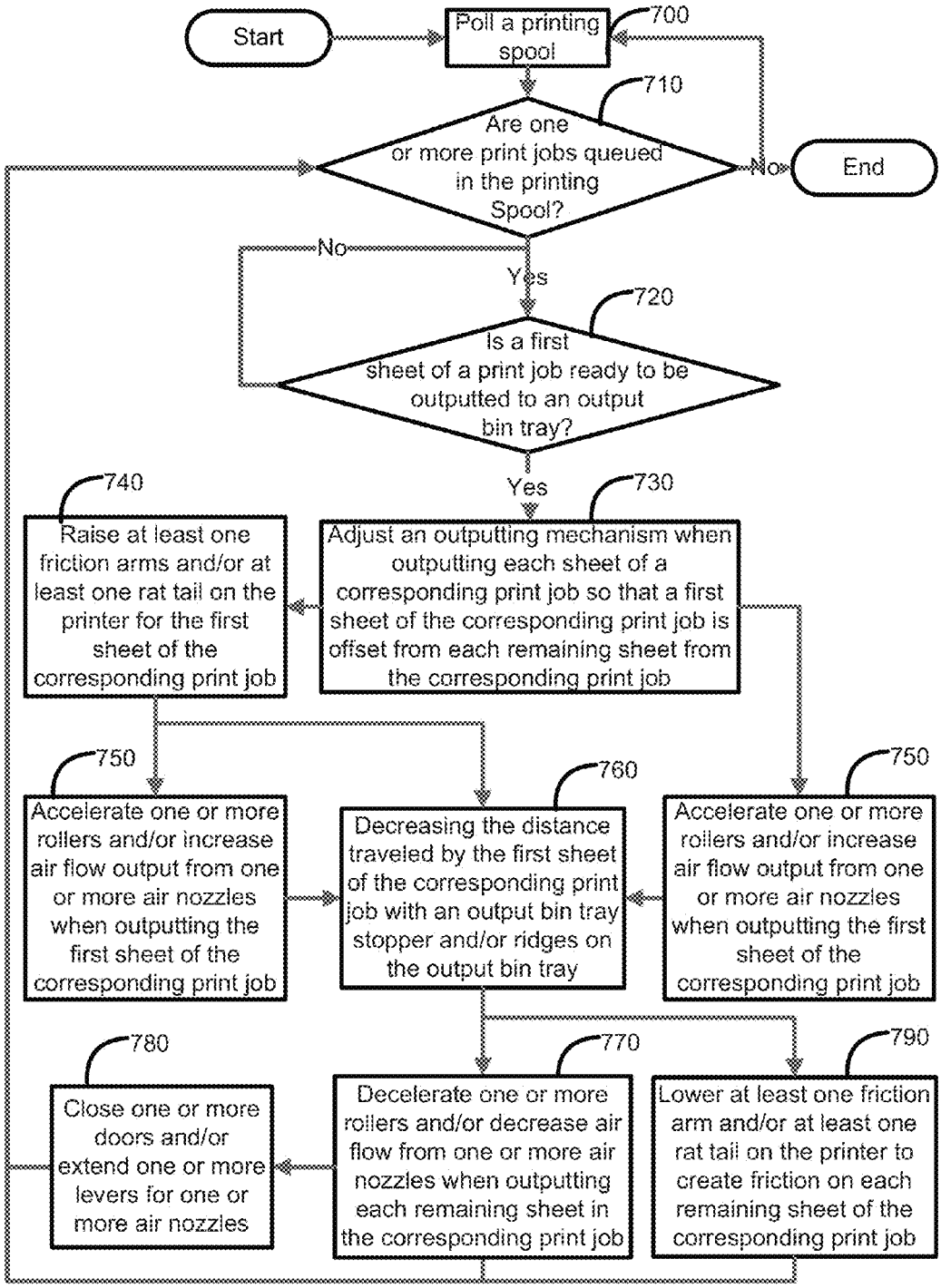
FIG. 7 is a flow chart illustrating a method for creating at least one first sheet job offset according to an embodiment of the invention.

FIG. 7 is a flow chart illustrating a method for creating at least one first sheet job offset according to an embodiment of the invention. The method of FIG. 7 may utilize a printing spool, a printer controller, a print controller software, an outputting mechanism, which may include one or more rollers and/or one or more air nozzles, at least one friction bias arms, at least one rat tails, one or more output bin trays, ridges on an output tray, and/or an output tray stopper. The method of FIG. 7 may utilize additional components and/or devices in addition and/or in lieu of those depicted in FIGS. 1, 2, 3, 4, and 6.

As illustrated in FIG. 7, a printer controller software may initially poll a printing spool 700. As noted above, the printing spool may include at least one print job and one or more additional print jobs that have been queued for printing with the printing apparatus. The printer controller software may then determine whether one or more print jobs are queued in the printing spool 710. If no print job is queued in the printing spool, then the method will continue to poll the printing spool for one or more print jobs queued in the printing spool 710 or the method will end.

If one or more print jobs are found to be queued in the printing spool, the print controller software will then determine whether a first sheet of the print job queued in the printing spool is ready to be outputted to an output bin tray 720. If a first sheet of the print job is not ready to be outputted to an output bin tray, the print controller will continue to determine whether a first sheet of the print job is ready to be outputted to an output bin tray 720.

If a first sheet of a print job is ready to be outputted to an output bin tray, the print control software will proceed to send an instruction to adjust an outputting mechanism when outputting each sheet of a corresponding print job so that a first sheet of the corresponding print job is offset from each remaining sheet from the corresponding print job 730. As noted above, an outputting mechanism may be one or more rollers, one or more air pressure nozzles, and/or other additional devices which may transition media out of the printing apparatus and into one or more output bin trays.

In adjusting an outputting mechanism when outputting each sheet of a corresponding print job so that a first sheet of the corresponding print job is offset from each remaining sheet from the corresponding print job, in one embodiment, the print controller software may send an instruction to raise at least one friction bias arm and/or at least one rat tail on the printing apparatus so that at least one friction bias arm and/or at least one rat tail does not make contact and create friction with the first sheet of the corresponding print job 740 when outputted from the printing apparatus. Alternatively and/or additionally, the print controller software may also send an instruction to an outputting mechanism to accelerate the first sheet of the corresponding print job out of the printing apparatus by accelerating one or more rollers and/or increasing air flow output from one or more air nozzles when outputting the first sheet of the corresponding print job 750.

In some circumstances, a user may wish to decrease the distance traveled by the first sheet to insure that it does not sail off the output print bin. An output tray stopper and/or ridges on the output bin tray may be utilized to decrease the distance traveled by the first sheet of the corresponding print job 760.

After the first sheet of the corresponding print job has been printed, the print controller software may send an instruction to decelerate one or more rollers and/or decrease air flow from one or more air nozzles when outputting each remaining sheet in the corresponding print job 770 so that each remaining sheet of the corresponding print job is decelerated out of the printing apparatus. If one or more air nozzles are used as an outputting mechanism, the print controller software may further send one or more instructions to close one or more doors and/or extend one or more levers for one or more air nozzles 780.

Alternatively, the print controller software may send an instruction to lower at least one friction bias arm and/or at least one rat tail on the printing apparatus to make contact and create friction with each remaining sheet of the corresponding print job 790. By lowering at least one friction bias arm, at least one rat tail, and/or decelerating an outputting mechanism, each remaining sheet of a corresponding print job will travel a shorter distance than the first sheet of the corresponding print job and will be stacked uniformly as illustrated in FIG. 5.

After each remaining sheet of the corresponding print job has been printed, at least one first sheet job offset will be created for the corresponding print job. The print controller software may then determine whether any more print jobs are queued in the printing spool 710. If no more print jobs are queued in the printing spool, the print controller software may continue to monitor and check whether a print job is queued in the printing spool 710 or the method will end. If one or more print jobs remain queued in the printing spool, the print controller software may continue to utilize the above disclosed method repeatedly to create one or more additional first sheet job offsets for each subsequent print job queued in the printing spool until no more print jobs remain in the queue.

What is claimed is:

1. A method for creating at least one first sheet job offset comprising:

determining whether a first sheet of a print job is ready to be outputted from a printing apparatus after the print job is determined to be queued in a printing spool;

controlling an outputting mechanism to accelerate the first sheet of the print job out of the printing apparatus, wherein controlling the outputting mechanism to accelerate the first sheet of the print job out of the printing apparatus includes controlling one or more air nozzles to increase air flow output for the first sheet of the print job; and controlling the outputting mechanism to decelerate each remaining sheet of the print job out of the printing apparatus, wherein accelerating the first sheet of the print job and decelerating each remaining sheet of the print job causes an offset of the first sheet of the print job from each remaining sheet of the print job after output from the printing apparatus, wherein controlling the outputting mechanism to decelerate each remaining sheet of the print job out of the printing apparatus includes controlling the one or more air nozzles to decrease air flow output for each remaining sheet of the print job.

2. The method of claim 1, wherein the printing apparatus includes at least one moveable friction element to make contact with and create friction with at least one sheet of the at least one print job, the method further comprising:

moving the at least one moveable friction element to a first position to avoid contact with the first sheet, to cause acceleration of the first sheet of the print job out of the printing apparatus; and moving the at least one moveable friction element to a second position to make contact with each remaining sheet of the print job, to cause deceleration of each remaining sheet of the print job out of the printing apparatus.

3. The method of claim 1, further comprising configuring at least one friction bias arm to make contact with and create friction with at least one sheet of the print job.

4. The method of claim 1 wherein controlling the one or more air nozzles to increase or decrease air flow includes at least one from the group consisting of opening or closing one or more doors or adjusting one or more levers for the one or more air nozzles.

5. A printing apparatus, comprising:

a print controller;

one or more outputting mechanisms coupled to the print controller;

a processor coupled to the print controller and a computer readable medium;

a print controller software executable from the print controller or the computer readable medium and configured to:

determine when a first sheet of a print job is ready to be outputted from the printing apparatus;

control the one or more outputting mechanisms to accelerate the first sheet of the print job out of the printing apparatus and create a first sheet job offset; and control the one or more outputting mechanisms to decelerate each remaining sheet of the print job out of the printing apparatus, wherein accelerating the first sheet of the print job and decelerating each remaining sheet of the print job causes an offset of the first sheet of the print job from each remaining sheet of the print job after output from the printing apparatus, wherein the one or more outputting mechanisms include one or more air nozzles configured to output air flow at different strengths under control of the print controller software, wherein the one or more air nozzles are configured to output air flow at a first strength to accelerate the first sheet of the print job output out of the printing apparatus, and wherein the one or more air nozzles are configured to output air flow at a second, lower strength to decelerate each remaining sheet of the print job out of the printing apparatus.

6. The printing apparatus of claim 5, further comprising one or more output bin trays connected to the printing apparatus, wherein the one or more output bin trays include an output tray bin stopper configured to prevent the first sheet of the print job from sailing off the one or more output bin trays.

7. The printing apparatus of claim 5 further comprising one or more output bin trays connected to the printing apparatus, wherein the one or more output bin trays include ridges configured to prevents the first sheet of the print job from sailing off the one or more output bin trays.

8. The printing apparatus of claim 5, wherein the print controller software is executable to further configure at least one moveable friction element to move between first and second positions, wherein moving the at least one movable friction element to the first position causes the at least one movable friction element to avoid contact with the first sheet of the print job to cause acceleration of the first sheet of the print job out of the printing apparatus, and wherein moving the at least one movable friction element to the second position causes the movable friction element to contact each remaining sheet of the print job to cause deceleration of each remaining sheet of the print job out of the printing apparatus.

9. The printing apparatus of claim 5 wherein the one or more outputting mechanisms include one or more exit rollers configured to rotate at various speeds under control of the print controller software, wherein the one or more exit rollers are rotated at a first speed to accelerate the first sheet of the print job out of the printing apparatus, and wherein the one or more exit rollers are rotated at a second, slower speed to decelerate each remaining sheet of the print job out of the printing apparatus.

10. The printing apparatus of claim 5 wherein the one or more air nozzles are connected to one or more doors configured to open and close or one or more levers configured to extend or retract to adjust air flow from the one or more air nozzles.

11. A non-transitory computer-readable storage medium storing a computer-readable program executable to cause a printing apparatus to:

poll a printing spool and determine whether a print job is queued in the printing spool;

determine when a first sheet of the print job is ready to be outputted from the printing apparatus;

send a first instruction to an outputting mechanism to accelerate output of a first sheet of the print job out of the printing apparatus; and send a second instruction to the outputting mechanism to decelerate output of each remaining sheet of the print job out of the printing apparatus, wherein accelerating the first sheet of the print job and decelerating each remaining sheet of the print job causes an offset of the first sheet of the print job from each remaining sheet of the print job after output from the printing apparatus, wherein the first instruction causes one or more air nozzles to increase air flow to cause acceleration of the first sheet of the print job out of the printing apparatus, and wherein the second instruction causes the one or more air nozzles to reduce air flow to cause deceleration of each remaining sheet of the print job out of the printing apparatus.

12. The non-transitory computer-readable medium of claim 11, wherein the first instruction causes movement of at least one friction element to a first position to cause the at least one friction element to avoid contact with the first sheet of the print job to allow acceleration of the first sheet of the print job out of the printing apparatus, and the second instruction causes movement of the at least one friction element to a second position to cause contact of the at least one friction element with each remaining sheet of the print job to cause deceleration of each remaining sheet of the print job out of the printing apparatus.

13. The non-transitory computer-readable storage medium of claim 11, wherein the first instruction causes a motor to increase a speed of one or more rollers to accelerate the first sheet of the print job out of the printing apparatus, and the second instruction causes the motor to decrease the speed of the one or more rollers to decelerate each remaining sheet of the print job out of the printing apparatus.

* * * * *

UNITED STATES PATENT AND TRADEMARK OFFICE

CERTIFICATE OF CORRECTION

PATENT NO. : 8,919,768 B2
APPLICATION NO. : 13/123671
DATED : December 30, 2014
INVENTOR(S) : Jiangxiao Mo It is certified that error appears in the above-identified patent and that said Letters Patent is hereby corrected as shown below:

In the Claims

In column 14, line 21, in Claim 12, delete “medium” and insert -- storage medium --, therefor.

Signed and Sealed this
Twenty-third Day of June, 2015

Michelle K. Lee

Michelle K. Lee
*Director of the United States Patent and Trademark Office*